US009243377B2

(12) United States Patent
Younan et al.

(10) Patent No.: US 9,243,377 B2
(45) Date of Patent: Jan. 26, 2016

(54) ARCTIC TELESCOPING MOBILE OFFSHORE DRILLING UNIT

(71) Applicants: Adel H. Younan, Sugar Land, TX (US); Jed M. Hamilton, Spring Branch, TX (US); Jean M. Audibert, Kerrville, TX (US); Yew Choong Patrick Lee, The Woodlands, TX (US)

(72) Inventors: Adel H. Younan, Sugar Land, TX (US); Jed M. Hamilton, Spring Branch, TX (US); Jean M. Audibert, Kerrville, TX (US); Yew Choong Patrick Lee, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/218,774

(22) Filed: Mar. 18, 2014

(65) Prior Publication Data

US 2014/0308080 A1 Oct. 16, 2014

Related U.S. Application Data

(60) Provisional application No. 61/810,576, filed on Apr. 10, 2013.

(51) Int. Cl.

| | |
|---|---|
| ***E02B 17/08*** | (2006.01) |
| ***E02B 17/00*** | (2006.01) |
| ***E02B 17/02*** | (2006.01) |

(52) U.S. Cl.

CPC ..... *E02B 17/0818* (2013.01); *E02B 17/0021* (2013.01); *E02B 17/021* (2013.01); *E02B 17/08* (2013.01); *E02B 2017/0039* (2013.01); *E02B 2017/0065* (2013.01); *E02B 2017/0069* (2013.01); *E02B 2017/0086* (2013.01)

(58) Field of Classification Search

CPC ..... E02B 17/00; E02B 17/04; E02B 17/08; E02B 17/0863; E02B 17/0818; E02B 2017/0043

USPC ..... 405/196, 197, 198, 199, 200, 203

See application file for complete search history.

(56) References Cited

U.S. PATENT DOCUMENTS

| | | | | | |
|---|---|---|---|---|---|
| 3,062,014 | A | * | 11/1962 | Newcomb | 405/205 |
| 3,916,632 | A | * | 11/1975 | Thomas | 405/196 |
| 3,996,754 | A | * | 12/1976 | Lowery | 405/197 |
| 4,158,516 | A | * | 6/1979 | Noblanc et al. | 405/196 |

(Continued)

FOREIGN PATENT DOCUMENTS

| | | |
|---|---|---|
| FR | 2382546 | 9/1978 |
| RU | 2 467 122 | 11/2012 |

OTHER PUBLICATIONS

Hnatiuk, J., "Molikpaq: An Integrated Mobile Arctic Drilling Caisson", OTC 4940, 1985 Offshore Technology Conference, May 6-9, 1985, pp. 373-380, Houston, TX.

(Continued)

*Primary Examiner* — Frederick L Lagman

(74) *Attorney, Agent, or Firm* — ExxonMobil Upstream Research-Law Department

(57) ABSTRACT

A system and method of drilling oil and gas wells in arctic or other environments having adverse conditions. A marine hydrocarbon operations structure may comprise a caisson body having a top surface which defines an opening and a shaft positioned within the opening. The shaft has an engagement member positioned on the external surface of the shaft. A lower jack house system is constructed and arranged to change the vertical position of the shaft through interaction with the engagement member. An operations platform supported by the shaft.

33 Claims, 9 Drawing Sheets

(56) References Cited

U.S. PATENT DOCUMENTS

| | | | | | |
|---|---|---|---|---|---|
| 4,192,110 | A | * | 3/1980 | Michel et al. | 52/111 |
| 4,451,174 | A | * | 5/1984 | Wetmore | 405/196 |
| 4,482,272 | A | * | 11/1984 | Colin | 405/198 |
| 4,969,776 | A | | 11/1990 | Bunce et al. | |
| 5,188,484 | A | * | 2/1993 | White | 405/198 |
| 5,609,442 | A | * | 3/1997 | Horton | 405/205 |
| 5,803,668 | A | * | 9/1998 | Seki et al. | 405/204 |
| 6,945,737 | B1 | * | 9/2005 | Xu | 405/205 |
| 8,523,491 | B2 | | 9/2013 | Brinkmann et al. | |
| 2007/0243063 | A1 | * | 10/2007 | Schellstede | 416/10 |

OTHER PUBLICATIONS

Wetmore, S.B., The Concrete Island Drilling System: Super Series (Super CIDS), OTC 4801, 16$^{th}$ Annual OTC, May 6-9, 1984, pp. 215-226, Houston, TX.

* cited by examiner

ARCTIC TELESCOPING MOBILE OFFSHORE DRILLING UNIT

CROSS REFERENCE TO RELATED APPLICATIONS

This application claims the benefit of U.S. Provisional No. 61/810,576 filed Apr. 10, 2013, and is incorporated herein by reference.

FIELD OF INVENTION

This invention generally relates to the field of oil and gas drilling and production and, more particularly, to a system and method of drilling oil and gas wells in arctic or other environments having heavy ice conditions.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

There was never a shortage of challenges facing the offshore industry in deep-water or arctic frontiers. Nowadays, however, the challenge is particularly daunting with the merger of the two frontiers in new arctic deep-water leases, such as the Beaufort Sea, Chuckchi Sea, Kara Sea and elsewhere. These regions typically accumulate extreme amounts of ice during a majority of the year. Even when sheet ice is not present, these Arctic regions often face drifting ice floes. The industry is aware of substantial reserves of hydrocarbons present in such regions, particularly in areas below relatively shallow waters.

Due to the increased interest in oil and natural gas exploration in these regions, consideration is first given to conventional drilling platforms. These, however, are not suitable for the adverse conditions because of their inability to withstand ice loads. Without the proper precautions and designing, drifting ice presents high-levels of risk to the drilling units.

However, known drilling units designed for application in the Arctic and other ice-heavy environments have a variety of issues. One known technique may be collectively referred to as artificial islands and barges. These structures have typically been used in very shallow waters, such as 10 to 15 m. These artificial islands and barges have been utilized in the Canadian, Caspian Seas, to name an example. Unfortunately, their use beyond these water depths is typically impractical and cost-prohibitive, besides their potential environmental impact. Moreover, artificial islands are purpose-built to drill only one well, hence they are not easily mobile.

Another concept utilizes a caisson-type gravity-base structure (GBS). The use of a GBS is typically suitable for shallow waters (20 to 40 m), and the GBS also exhibits significant lateral capacity to resist ice loads. However, due to their constant height, these concepts cannot accommodate a range of water depths. Therefore, that precludes them from providing a constant water clearance which hampers safe lifeboat evacuation Jack-ups or fortified jack-ups may be applied in the Arctic. While these structures can provide a constant clearance in a range of water depth, they suffer from limited foundation and jack-up leg capacity that typically preclude them from drilling in significant ice conditions. Even in open water season, they may not be able to resist a drifting ice floe or iceberg which may be present even in that season.

Floating systems are designed for deeper water depths (such as 100-150 m). However, known floating systems are limited by their insignificant station-keeping capacity compared to drifting ice or iceberg demands. Hence, they are limited to open water season, and even then require the use of icebreakers and a well-thought ice management plan.

Lastly, variable seafloor conditions, including very soft clays, often occur at Arctic and other sites. GBSs are typically the platform of choice to resist harsh environmental conditions, such as, but not limited to, ice forces experienced in the Arctic. Concrete or steel skirts are generally used to provide extra resistance to prevent the GBS from sliding due to ice forces, but they are expensive to construct and they need to be specifically designed to match site specific soil conditions.

Thus, there is a need for improvement in this field.

SUMMARY OF THE INVENTION

The present invention provides an arctic telescoping mobile offshore drilling unit and a method of operating the same.

One embodiment of the present disclosure is a marine hydrocarbon operations structure comprising: a caisson body having a top surface which defines an opening; a shaft positioned within the opening, the shaft has an external surface and an interior, the shaft having an engagement member positioned on the external surface of the shaft; a lower jack house system constructed and arranged to change the vertical position of the shaft through interaction with the engagement member; and an operations platform supported by the shaft.

The foregoing has broadly outlined the features of one embodiment of the present disclosure in order that the detailed description that follows may be better understood. Additional features and embodiments will also be described herein.

BRIEF DESCRIPTION OF THE DRAWINGS

The present invention and its advantages will be better understood by referring to the following detailed description and the attached drawings.

Figure 2:
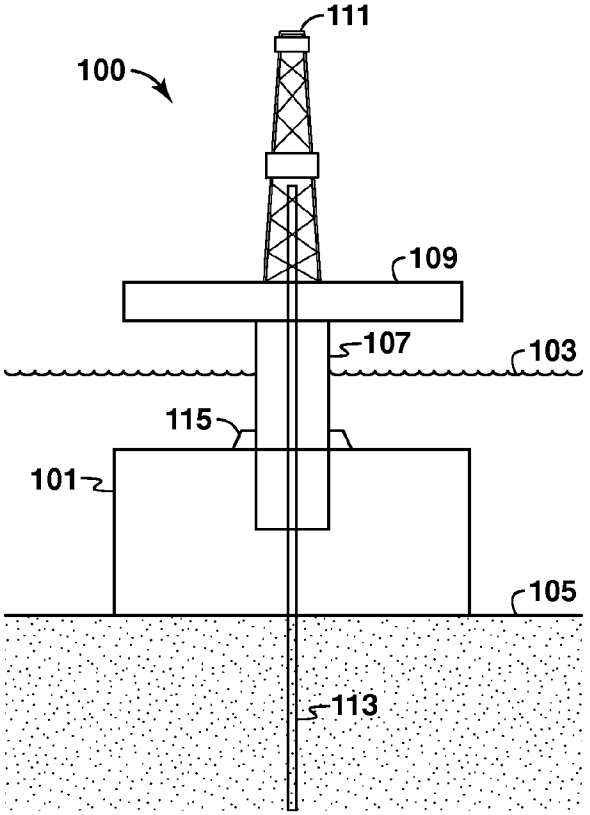
FIG. 2 is a cross-sectional side view of the arctic telescoping mobile offshore drilling unit depicted in FIG. 1 in which the telescoping shaft is in an extended position according to one embodiment of the present disclosure.

It should be noted that the figures are merely examples of several embodiments of the present invention and no limitations on the scope of the present invention are intended thereby. Further, the figures are generally not drawn to scale, but are drafted for purposes of convenience and clarity in illustrating various aspects of certain embodiments of the invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. At least one embodiment of the invention is shown in great detail, although it will be apparent to those skilled in the relevant art that some features that are not relevant to the present invention may not be shown for the sake of clarity.

Embodiments of the present disclosure overcome two limitations of existing shallow water concepts: weak lateral capacity and/or limited range of water depth. Embodiments of the present disclosure comprise a caisson body, a telescoping shaft, deck and at least one jacking house constructed and arranged to raise and/or lower the telescoping shaft. In some embodiments, the caisson body has a height of 50 meters, though other heights may be utilized. In some embodiments, the telescoping shaft is constructed and arranged to extend some height (such as, but not limited to, 40 meters) beyond the roof of the caisson body. In some embodiments, the platform deck is supported by the telescoping shaft. In other embodiments, the platform deck is supported by a jack-up leg that can extend beyond the telescoping shaft in order to raise the deck to a safe level above ice floes, iceberg sails and/or wave crests to name a few non-limited examples. In those embodiments comprising a jack-up leg, a second jacking house is provided at the shaft top in order to raise and/or lower the jack-up leg.

Figure 1:
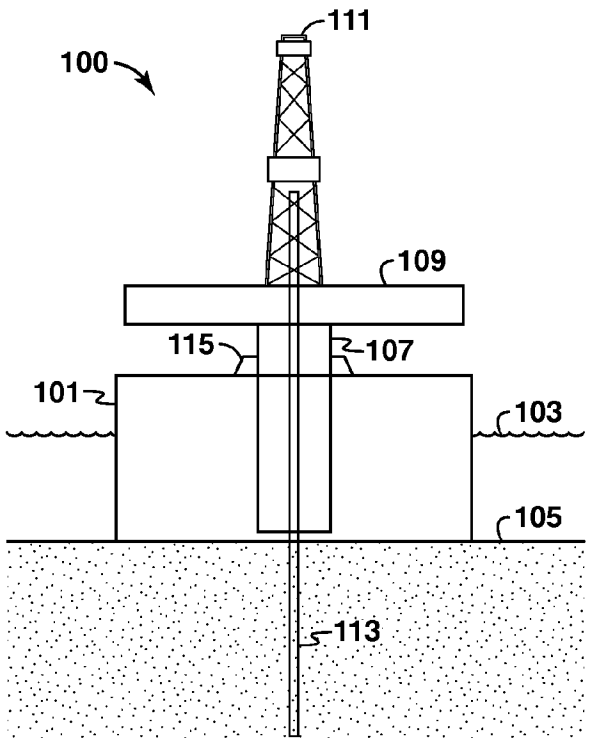
FIG. 1 is a cross-sectional side view of an arctic telescoping mobile offshore drilling unit according to one embodiment of the present disclosure.

FIG. 1 is a cross-sectional side view of an arctic telescoping mobile offshore drilling unit 100 according to one embodiment of the present disclosure. As depicted, the arctic telescoping mobile offshore drilling unit (AT-MODU) 100 comprises a body member or caisson 101 designed to sit in a body of water 103 and engage an area of seabed 105 selected for drilling operation. Through proper engagement with seabed 105 and appropriate design, body member 101 is constructed and arranged to withstand loads from drifting ice floes. In one embodiment, body member 101 takes the form of a gravity based structure. In some embodiments, body member 101 is equipped with ballast tanks. As appreciated by those skilled in the art, the filling and emptying of the ballast tanks provides control of floatation of body member 101.

In the depicted embodiment, body 101 has an opening on its upper surface which allows the receipt of a telescoping shaft 107. As illustrated, the longitudinal dimension of telescoping shaft 107 is substantially perpendicular to the upper surface of body 101. Like body 101, telescoping shaft 107 is constructed and arranged to withstand the forces applied by drifting ice floes. A drilling platform 109 is supported by telescoping shaft 107. Platform 109 is equipped with a drilling derrick 111 as well as other equipment and facilities common to such platforms, such as, but not limited to, crew quarters, lifting cranes, living quarters and a heliport. Drilling derrick 111 is operatively connected to a drilling unit 113 which is positioned in the interior of telescoping shaft 107 and body 101. By positioning the drilling unit 113 within telescoping shaft 107 and body 101, drilling unit 113 is protected from damage caused by ice floes.

Positioned proximate to the opening in body 101 are jack-up houses 115. Jack-up houses 115 are engaged to body 101 and are functionally engaged to telescoping shaft 107. As explained in more detail below, the operation of jack-up house 115 allows the telescoping shaft 107 to extend and retract relative to body 101.

As shown in FIG. 1, telescoping shaft 107 may remain in a retracted position when the water 103 depth is less than the height of body 101. However, when placed in locations where the water height is greater than the height of body 101, telescoping shaft 107 may be placed in an extended position. Once such embodiment is depicted in FIG. 2 in which the telescoping shaft 107 is in an extended position. The amount by which telescoping shaft 107 is extended may be based on a variety of conditions or parameters, such as, but not limited to, potential or identified hazards of the surrounding environment, clearance height between platform 109 and the surface of the water 103, etc.

Figure 3:
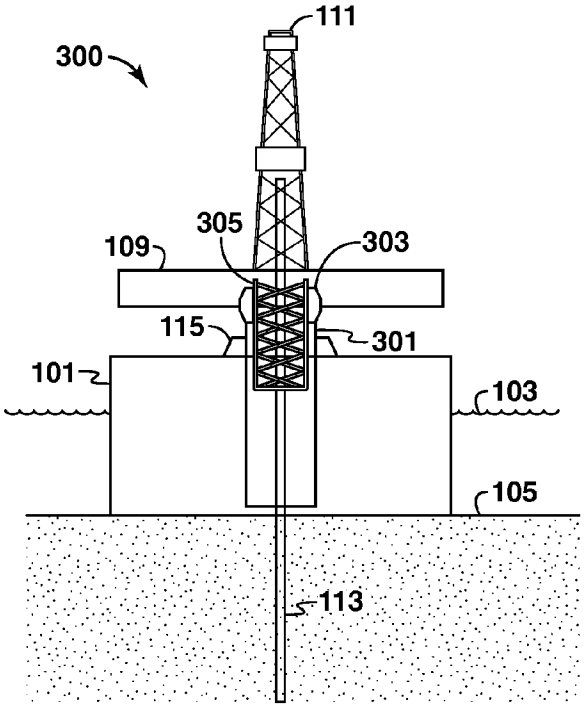
FIG. 3 is a cross-sectional side view of an arctic telescoping mobile offshore drilling unit according to a further embodiment of the present disclosure.

FIG. 3 is a cross-sectional side view of an AT-MODU 300 according to a further embodiment of the present disclosure. AT-MODU 300 has many of the same components as AT-MODU 100 depicted in FIG. 1. For convenience, many of the common components have the same reference numerals. Unlike the FIG. 1 embodiment, telescoping shaft 301 of AT-MODU 300 does not directly support platform 109. Instead, platform 109 is supported by a jack-up leg 305 which is controlled by the operation of upper jack houses 303. Jack houses 303 are engaged to telescoping shaft 301 and are functionally engaged to leg 305. Therefore, the operation of jack house 303 allows leg 305 to extend and retract relative to the top of telescoping shaft 301.

Figure 4:
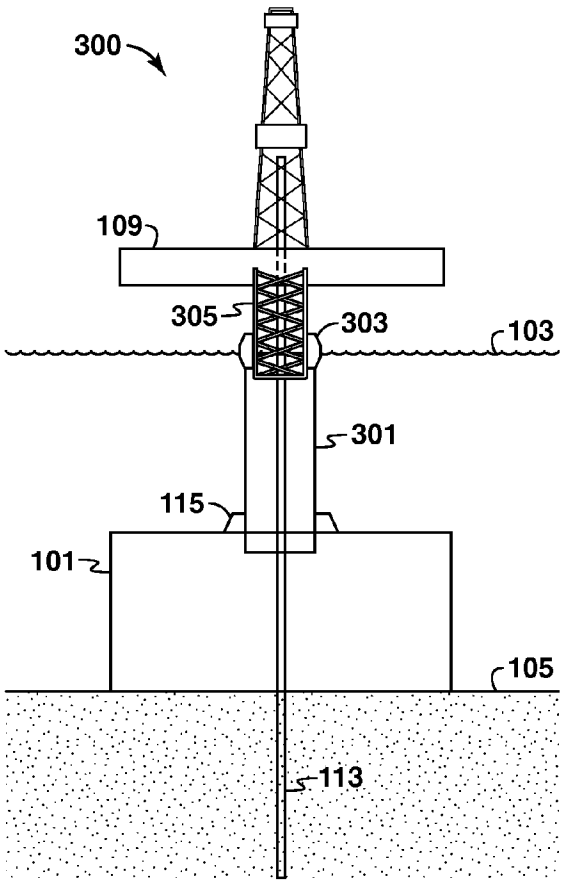
FIG. 4 is a cross-sectional side view of the arctic telescoping mobile offshore drilling unit depicted in FIG. 3 in which the telescoping shaft and jack-up leg are in an extended position according to one embodiment of the present disclosure.

FIG. 4 is a cross-sectional side view of the AT-MODU 300 depicted in FIG. 3 in which the telescoping shaft 301 and jack-up leg 305 are in an extended position according to one embodiment of the present disclosure. As shown, the AT-MODU 300 is installed in a body of water 103 having a depth substantially greater than the height of body 101. Therefore, in order to protect drilling unit 113 from drifting ice floes, telescoping shaft 307 is extended such that the top portion of shaft 307 is at or above the surface of the water 103. In order to provide sufficient clearance between the surface of the water 103 and the bottom of platform 109, leg 305 is extended to the determined height.

Figure 5:
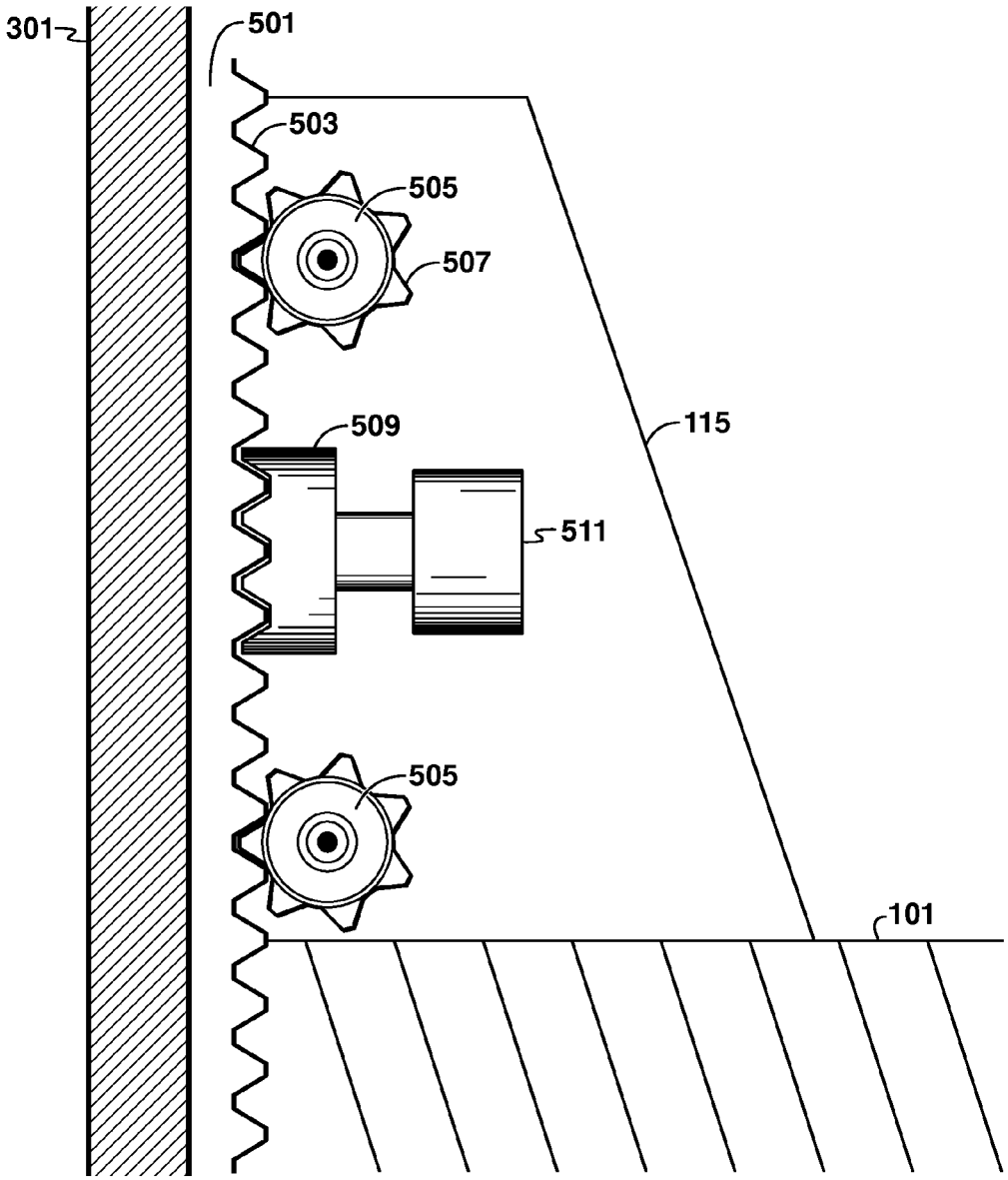
FIG. 5 is an enlarged cross-sectional view of the components housed by the jack house and their engagement with the telescoping shaft according to one embodiment of the present disclosure.

One aspect of embodiments of the present disclosure is to provide sufficient protection to the drilling unit by surrounding it by a body structure and telescoping shaft. In order to provide protection at various heights, the telescoping shaft is constructed and arranged to move in the vertical direction. There are a variety of techniques and associated equipment that would allow the telescoping shaft to move between positions. FIG. 5 provides one non-limiting embodiment to do so.

FIG. 5 is an enlarged cross-sectional view of the components housed by a jack house 115 and their engagement with the telescoping shaft 301 according to one embodiment of the present disclosure. Though reference numeral 301 is used in FIG. 5, those of ordinary skill in the art would appreciate that telescoping shaft 107 would be equally applicable. The depicted embodiment raises and lowers the telescoping shaft 107 through the use of a rack and pinion jacking system. More specifically, a rack member 501 having a plurality of teeth 503 is provided on the external surface of telescoping shaft 301. The rack member 501 may be attached to, or otherwise provided on, telescoping shaft 301 according to known techniques. While only one rack member 501 is depicted, other embodiments include a plurality of rack members disposed at various point around the external circumference of the telescoping shaft.

For each rack member, there is an associated jack house 115. In the depicted embodiment, jack house 115 is affixed, attached or otherwise secured to body 101 proximate to the body opening in which telescoping shaft 301 is disposed. As illustrated in FIG. 5, jack house 115 encloses and protects pinion gears 505, rack chock 509 and actuator 511. Pinion gears 505 are equipped with a plurality of pinion teeth 507 which are constructed and arranged to matingly engage rack teeth 503. Though not depicted, hydraulic or electric drive mechanisms are also provided to power the pinion gears 505 for rotation in the necessary direction in order to raise or lower telescoping shaft 301.

Once the telescoping shaft 301 reaches the appropriate height, the operation of the pinion gears 505 is stopped. In some embodiments, the pinion gear drive system has a self-locking design which allows the telescoping shaft to maintain the proper height. In other embodiments, further locking mechanisms may be utilized in order to maintain telescoping shaft position. In the embodiment depicted in FIG. 5, a toothed rack chock 509 is provided. The teeth of rack chock 509 is constructed and arranged to conform to rack teeth 503. When the rack chock 509 is engaged via operation of actuator 511, the rack chock 509 locks the telescoping shaft 301 against vertical movement thereby preventing pinion gears 505 from experiencing excessive loads.

Figure 6:
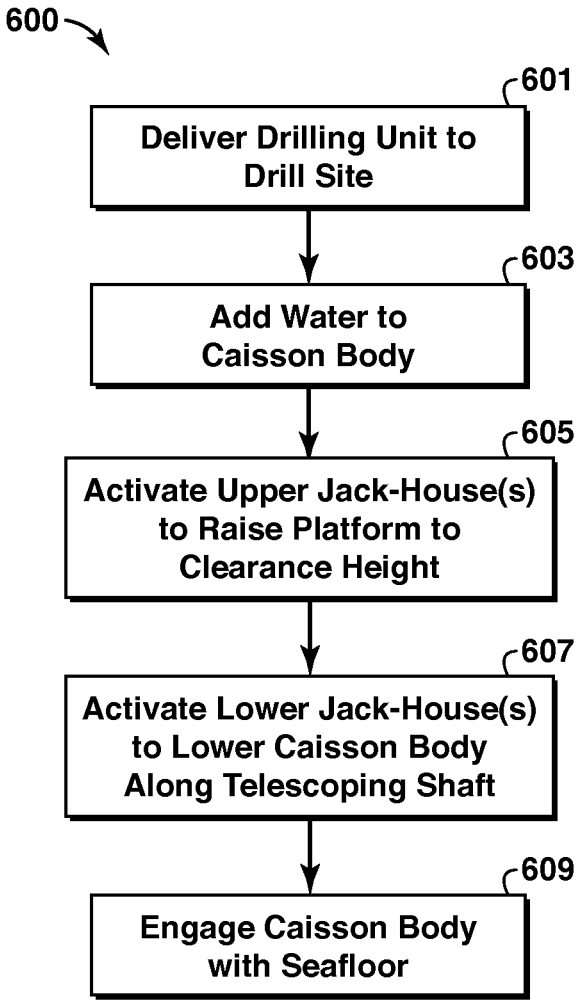
FIG. 6 is a flow chart showing the basic steps of an installation process of an arctic mobile offshore drilling unit according to one embodiment of the present disclosure.

The flow chart of FIG. 6 will now be referred to in describing one embodiment of the present disclosure for installing an AT-MODU. The depicted process 600 begins by delivering the AT-MODU to a drill site (block 601). The techniques and methodologies for selecting the drill site are well known in the art and beyond the scope of the present disclosure. Additional, the AT-MODU may be delivered to the drill site using known techniques. In embodiment, the AT-MODU may be pulled to the drill site using tug boats, barges or other marine vessels. In order embodiments, AT-MODU may be self-propelled.

At block 603, water is added to the caisson body. At block 605, the jack houses operating the jack-up leg are engaged in order to raise the platform to the necessary clearance height. As water is added, the weight of the body increased thereby causing it to sink. Therefore, the jack houses operating the telescoping shaft are also engaged to extend the telescoping shaft (block 607). Once the body touches the seafloor, known techniques are applied to fixedly engage the caisson body to the seafloor such that the body will not laterally move due to the horizontal forces applied by drifting ice floes (block 609). After the body has been put into place, drilling operations may commence.

As presented herein, some embodiments of the present disclosure do not require the use of a jack-up leg and its associated jack houses. Therefore, block 605 may not be necessary. Instead, the jack house(s) operatively engaged to the telescoping shaft may be activated before the caisson body begins to sink. By extending the telescoping shaft up in the vertical direction before the caisson body begins to sink, the platform may be raised to the appropriate clearance height above the surface of the water.

Figure 7C:
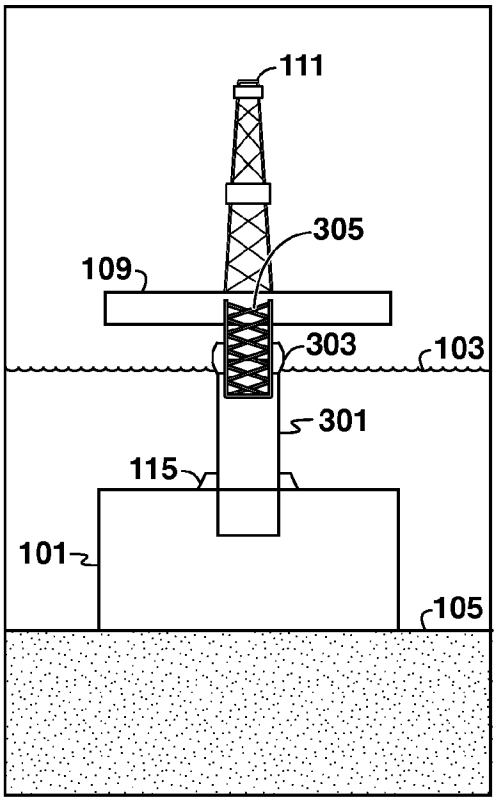
FIGS. 7(A), 7(B) and 7(C) depict cross-sectional side views of an artic mobile offshore drilling unit during an installation process according to one embodiment of the present disclosure.
Figure 7B:
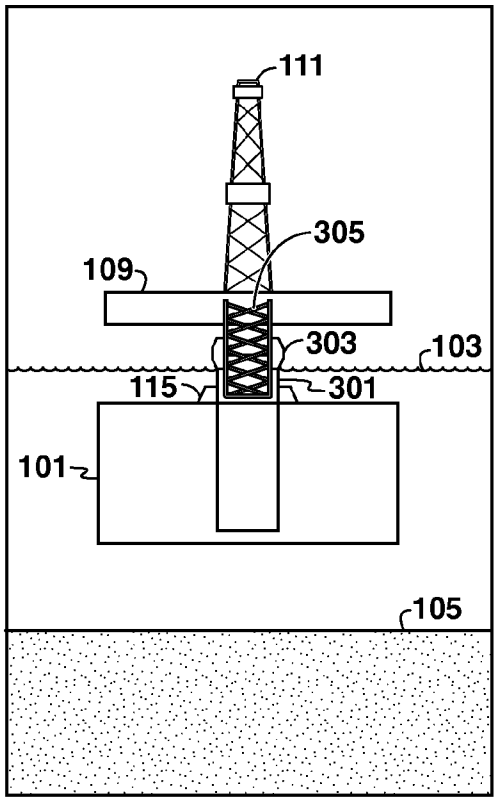
Figure 7A:
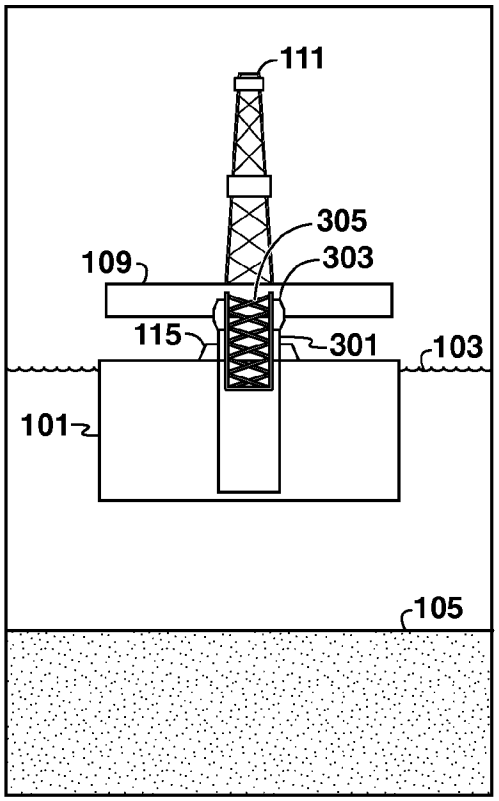

FIGS. 7(A), 7(B) and 7(C) depict cross-sectional side views of an AT-MODU during an installation process according to one embodiment of the present disclosure. As depicted in FIG. 7(A), the AT-MODU is delivered to the pre-determined drill site. In one embodiment, the telescoping shaft 301 and jack-up leg 305 are in their complete retracted position while in transit. Once it position, the jack houses 303 operating the jack-up leg 305 are engaged in order to raise the platform 109 to the necessary clearance height above the surface of the water 103. In addition, water is added to body 101 causing it to sink. FIG. 7(B) depicts the AT-MODU in which the platform has been raised to the sufficient clearance height and the caisson body has sunk slightly.

Eventually, the jack houses 115 constructed and arranged to operate the telescoping shaft 301 are also engaged in order to extend the telescoping shaft 301. Eventually, known techniques are utilized to engage the body 101 to the seafloor 105. After the body 101 has been put into place, drilling operations may commence. FIG. 7(C) depicts the AT-MODU in its final, installed configuration according to one embodiment.

Figure 8:
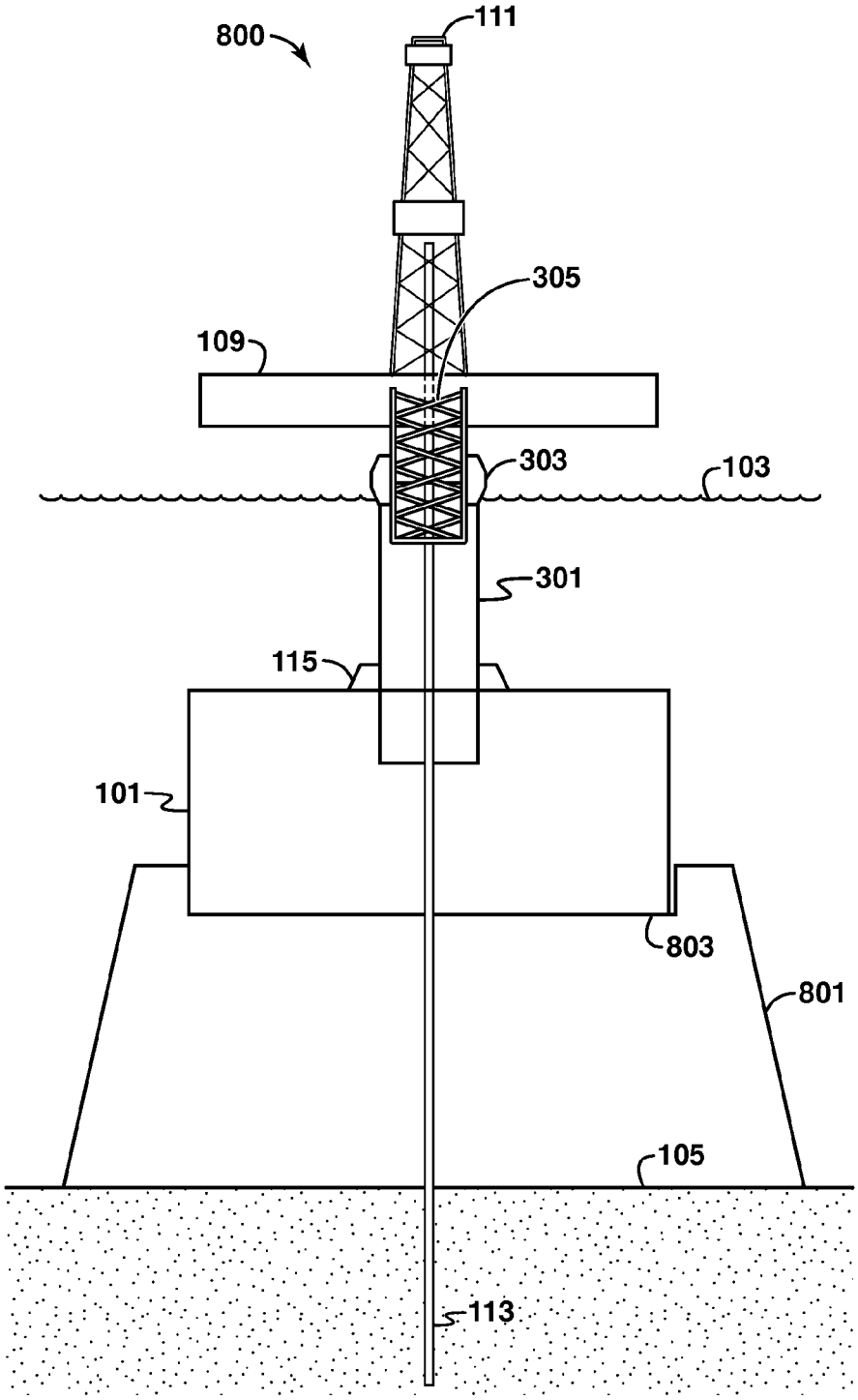
FIG. 8 is a cross-sectional side view of an arctic telescoping mobile offshore drilling unit according to another embodiment of the present disclosure.

FIG. 8 is a cross-sectional side view of an AT-MODU 800 according to another embodiment of the present disclosure. AT-MODU 800 has most of the same components as AT-MODU 300 depicted in FIG. 3. Unlike the FIG. 3 embodiment, AT-MODU 800 further includes a base structure 801. In the depicted embodiment, base structure 801 has a support surface 803 which is recessed from its upper surface. Support surface 803 allows for receipt of and engagement with a bottom portion of body member 101. The arrangement depicted in FIG. 8 permits drilling in deeper arctic water than may be allowed for other embodiments disclosed herein. The usefulness of AT-MODU 800 depends on a variety of factors, such as, but not limited to, water depth, severity of ice load, and/or soil capacity at a given location. In the event year-round drilling is not possible in at a given water depth, base structure 801 may remain engaged to the seabed 105 with the rest of the system is towed away. The base structure 801 may then continue to protect a BOP and/or drilling riser.

Figure 9:
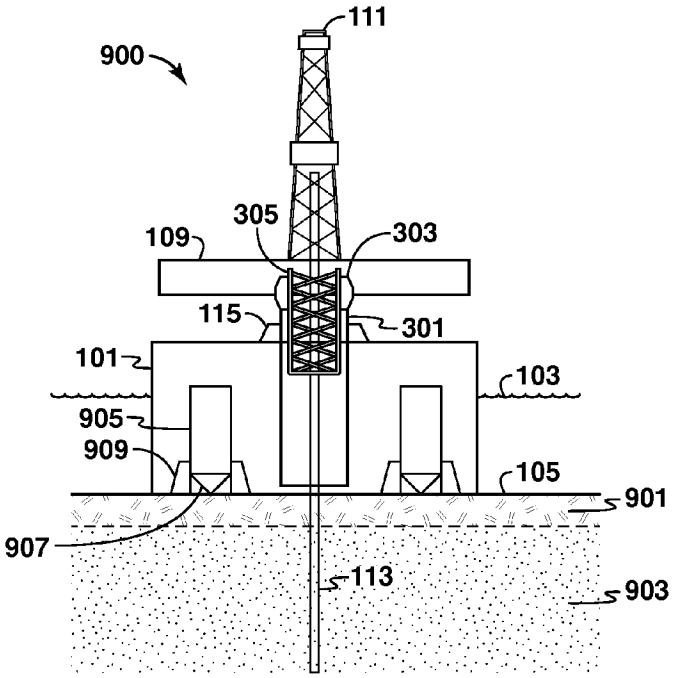
FIG. 9 is a cross-sectional side view of an arctic telescoping mobile offshore drilling unit according to a further embodiment of the present disclosure.

FIG. 9 is a cross-sectional side view of an AT-MODU 900 according to a further embodiment of the present disclosure. AT-MODU 900 has many of the same components as AT-MODU 300 depicted in FIG. 3. Unlike the FIG. 3 embodiment, AT-MODU 900 further includes a plurality of foundation caissons 905 each having an associated spud can 907 and jack house system 909. The foundation caissons 905 and jack house system 909 are positioned within body 101 and are therefore protected from the subsea environment. AT-MODU 900 may be particularly helpful in locations in which the seabed 105 consists of weak soil 901 and competent soil 903. In those locations, the body 101 may not be sufficient to hold the AT-MODU in place as the lower portions of the body 101 would only be engaged to weak soil 901. FIG. 9 depicts the foundation members 905 in a "retracted" position. In some embodiments, the foundation caissons 905 are mechanically coupled to their associated jack house systems 909 in the same or similar fashion as the arrangement depicted in FIG. 5.

Figure 10:
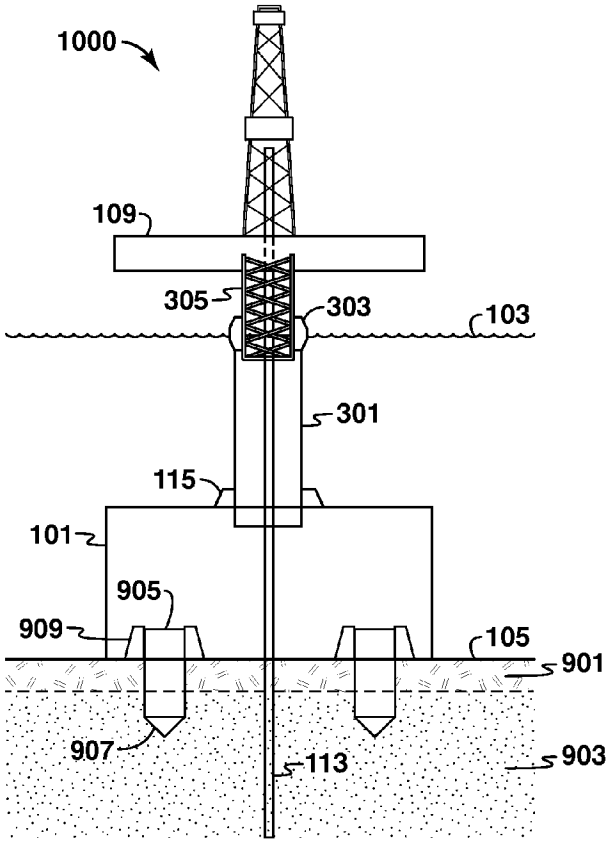
FIG. 10 is a cross-sectional side view of the arctic telescoping mobile offshore drilling unit depicted in FIG. 9 in which the foundation caissons are in a secured position according to one embodiment of the present disclosure.

As depicted in FIG. 10, the foundation caissons 905 may be driven into the seabed 105 through operation of the jack houses 909. Those of ordinary skill in the art will appreciate that the spud cans 907 are positioned at the foot of the foundation caisson 905 to aid in the positioning of the caisson. Foundation caissons 905 can have a variety of lengths based on design objectives and seabed characteristics near a potential drill site. In one embodiment, foundation caissons 905 have a length sufficient to penetrate the competent soil 903 when the caissons are placed in the "extended" position. In such an embodiment, the foundation caissons 905 provide additional lateral resistance in the event the AT-MODU 900 is struck by drifting ice floes, or encounters other forces. The use of foundation caissons 905 is not limited to AT-MODUs; foundation caissons 905 may also be used in connection with conventional GBSs.

Figure 11:
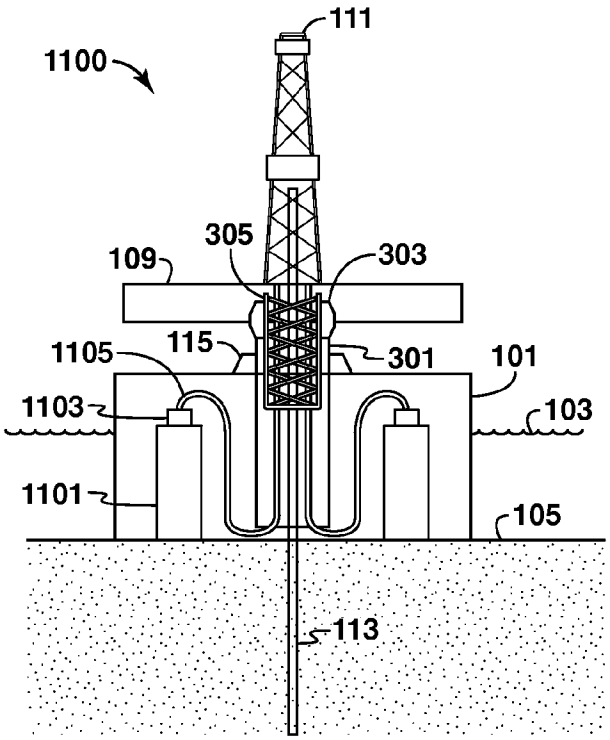
FIG. 11 is a cross-sectional side view of an arctic telescoping mobile offshore drilling unit according to another embodiment of the present disclosure.

FIG. 11 is a cross-sectional side view of an AT-MODU 1000 according to another embodiment of the present disclosure. AT-MODU 1000 is similar to AT-MODU 900 depicted in FIG. 9. However, instead of the foundation caisson being driven by jack houses, AT-MODU 1000 utilizes suction caissons 1101 which are shown in their retracted position. In order to generate the differential pressure required to install or remove the suction caisson body 1001 into or from the seabed 105, a pump 1103 is positioned on the top of the caisson body or on a caisson body cover or lid. Pump 1103 is constructed and arranged to pump fluid either into or from the area interior to the caisson body 1001. Though not depicted, the top of the caisson body has at least one opening or aperture which allows pump 1103 to deliver fluid (such as, but not limited to, water) to and from the interior of caisson body 1101. Pump 1103 may be controlled through a variety of known techniques. A control umbilical 1105 is provided to operate and control pump 1103. In the depicted embodiment, the control umbilicals 1105 are positioned within telescoping shaft 301 and are provided to platform 109. In other non-limited embodiments, pump 1103 may be operated by a remotely operated vehicle or through a wireless control system. After pump 1103 has been appropriately operated and suction caisson 1001 is embedded into the seabed 105, the suction caissons 1101 provide additional lateral resistance in the event the AT-MODU 1000 is struck by drifting ice floes, or encounters other forces. The use of suction caissons 1101 is not limited to AT-MODUs; suction caissons 1101 may also be used in connection with conventional GBSs.

Figure 12:
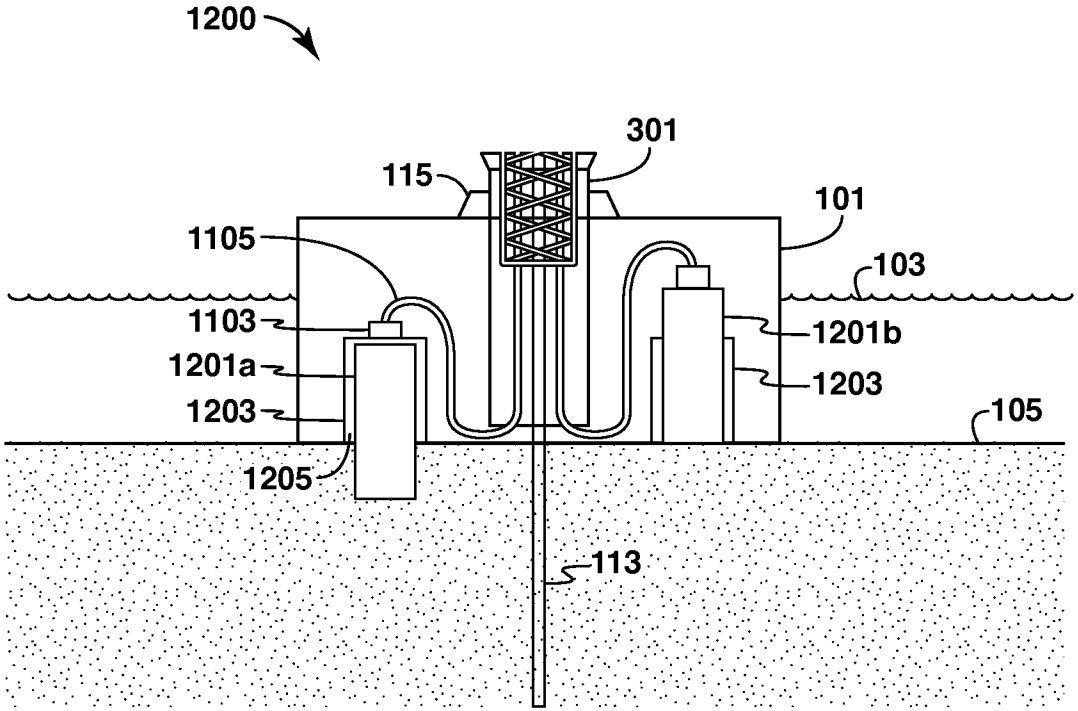
FIG. 12 is a partial, cross-sectional side view of an arctic telescoping mobile offshore drilling unit having one suction caisson installed at a target depth and another suction caisson in its retracted position within the guiding sleeve.

FIG. 12 is a partial, cross-sectional side view of an AT-MODU 1200 according to one embodiment of the present disclosure. AT-MODU 1200 is similar to AT-MODU 1100 depicted in FIG. 11 and share many of the same components. Components of AT-MODU 1200 above jack house 115 are not shown but they are identical to those in AT-MODU 1100. AT-MODU 1200 is shown having one suction caisson 1201*a* installed at a target depth and another suction caisson 1201*b* in its retracted position within a guiding sleeve 1203. Guiding sleeve 1203 is positioned radially outward of caisson 1201*a*, 1201*b*. In operation, sand 1205 is used to fill the annulus between the caisson 1201*a* and guiding sleeve 1203 once the suction caisson 1201*a* is embedded in place. Sand 1205 ensures load transfer between body member 101 and the suction caisson 1201*a*. Once the structure is ready to be moved to the next location, the sand 1205 is jetted and pumped out in order to allow the suction caisson 1201*a* to be retrieved. The use of suction caissons 1201*a*, 1201*b* is not limited to AT-MODUs; the suction caissons may also be used in connection with conventional GBSs.

The embodiments of the AT-MODU described herein permit arctic year-round drilling in a range of water depths, such as, but not limited to, 30 meters to 100 meters. In such water depths, the AT-MODU provides optimum water clearance to allow safe evacuation. Beyond certain water depths, however, it may be more appropriate to use the AT-MODU 800 embodiment.

While the present disclosure primarily focuses on drilling equipment, the principles described herein may also apply to mobile production units. Therefore, instead of drilling equipment, the platform may be equipped with the appropriate hydrocarbon production and/or extraction equipment.

While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional blocks not shown herein. While the figures illustrate various actions occurring serially, it is to be appreciated that various actions could occur in series, substantially in parallel, and/or at substantially different points in time.

Disclosed aspects may be used in hydrocarbon management activities. As used herein, "hydrocarbon management" or "managing hydrocarbons" includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, and any other hydrocarbon-related acts or activities. The term "hydrocarbon management" is also used for the injection or storage of hydrocarbons or $CO_2$, for example the sequestration of $CO_2$, such as reservoir evaluation, development planning, and reservoir management. In one embodiment, the disclosed methodologies and techniques may be used to extract hydrocarbons from a subsurface region. In one embodiment, an arctic telescoping mobile offshore drilling unit is provided and properly positioned with respect to a prospective hydrocarbon reservoir within a subsurface region. In some embodiments, hydrocarbon extraction may then be conducted to remove hydrocarbons from the subsurface region, which may be accomplished by drilling at least one well using oil drilling equipment onboard the platform of the AT-MODU. With the exception of the AT-MODU capabilities described herein, the equipment and techniques used to drill a well and/or extract the hydrocarbons are well known by those skilled in the relevant art. Other hydrocarbon extraction activities and, more generally, other hydrocarbon management activities, may be performed according to known principles.

The following lettered paragraphs represent non-exclusive ways of describing embodiments of the present disclosure.

A. A marine hydrocarbon operations structure comprising: a caisson body having a top surface which defines an opening; a shaft positioned within the opening, the shaft has an external surface and an interior, the shaft having an engagement member positioned on the external surface of the shaft; a lower jack house system constructed and arranged to change the vertical position of the shaft through interaction with the engagement member; and an operations platform supported by the shaft.

A1. The structure of paragraph A further comprising: a jack-up leg positioned within the interior of the shaft; and an upper jack house system mechanically coupled to the jack-up leg and constructed and arranged to change the vertical position of the jack-up leg, wherein the platform is supported by the jack-up leg.

A2. The structure of paragraph A1, wherein the upper jack house system is affixed to the external surface of the shaft.

A3. The structure as in any one of the preceding paragraphs further comprising a base structure having a lower surface and a support surface, the lower surface is constructed and arranged to engage a seabed, the support surface is constructed and arranged to engage a bottom portion of the caisson body.

A4. The structure of paragraph A3, wherein the support surface is recessed from an upper surfaced of the base structure.

A5. The structure as in any one of the preceding paragraphs, wherein the engagement member is a rack member having a plurality of rack teeth.

A6. The structure of paragraph A5, wherein the upper jack house system comprises at least one pinion gear having a plurality of pinion teeth constructed and arranged to matingly engage the rack teeth.

A7. The structure of paragraph A5 or A6, wherein the upper jack house system comprises a chock member having a plurality of chock teeth constructed and arranged to conform to the rack teeth.

A8. The structure of paragraph A7, wherein the upper jack house system comprises an actuator mechanically coupled to the chock member, the actuator is constructed and arranged to move the chock member between a first position and a second position.

A9. The structure as in any one of paragraphs A6, A7, or A8, wherein the pinion gears are constructed and arranged to be driven by an electric drive mechanism.

A10. The structure as in any one of the preceding paragraphs, wherein the caisson body is a gravity based structure.

A11. The structure as in any one of the preceding paragraphs, wherein the lower jack house system is attached to the top surface of the caisson body.

A12. The structure as in any one of the preceding paragraphs, wherein the caisson body and shaft are constructed and arranged to resist ice loads.

A13. The structure as in any one of the preceding paragraphs, wherein the hydrocarbon operations comprises drilling, the platform supports a drilling derrick which is operatively connected to a drilling riser, a first portion of the drilling riser is positioned within the interior of the shaft.

A14. The structure as in any one of the preceding claims further comprising: at least one foundation member positioned within the caisson; and means associated with each foundation member for vertically moving the associated foundation member into the seabed.

A15. The structure of paragraph A14, wherein the means for vertically moving the associated foundation member into the seabed is at least one jack house system A16. The structure of paragraph A14, wherein the means for vertically moving the associated foundation member into the seabed is a suction caisson system comprising a pump and control umbilical.

A17. The structure of paragraph A16, wherein a portion of the control umbilical is located within the shaft.

A18. The structure as in any one of paragraphs A14, A15, A16, or A17 further comprising a guiding sleeve positioned radially outward from foundation member.

B. A method for installing mobile drilling structure comprising: providing the mobile drilling structure which comprises a caisson body having a top surface which defines an opening, the caisson body houses a plurality of ballast tanks, a shaft positioned within the opening, the shaft having an engagement member positioned on the external surface of the shaft, a lower jack house system constructed and arranged to change the vertical position of the shaft through interaction with the engagement member, and a drilling platform supported by the shaft; delivering the mobile drilling structure to a drill site; adding water to the ballast tank; operating the lower jack house system to raise the shaft; engaging a bottom of the caisson body to a seabed.

B1. The method of paragraph B, wherein the mobile drilling structure further comprises a jack-up leg positioned within the interior of the shaft and an upper jack house system mechanically coupled to the jack-up leg and constructed and arranged to change the vertical position of the jack-up leg, wherein the platform is supported by the jack-up leg.

B2. The method of paragraph B1 further comprising operating the upper jack house to raise platform to a clearance height.

B3. The method as in any one of the preceding paragraphs further comprising installing a drilling riser that is operatively connected to a drilling derrick on the platform, wherein a portion of the drilling riser is positioned within the shaft.

B4. The method as in any one of the preceding paragraphs, wherein the mobile drilling structure further comprises at least one foundation member positioned within the caisson.

B5. The method of paragraph B4 further comprising lowering the at least one foundation member into the seabed.

B6. The method of paragraph B5, wherein the at least one foundation member is lowered into the seabed through operation of a jack house system mechanically coupled to the foundation member.

B7. The method of paragraph B5, wherein the at least one foundation member is lowered into the seabed through operation of a suction caisson system comprising a pump and a control umbilical.

B8. The method of paragraph B7, wherein the suction caisson system further comprises a guidance sleeve positioned radially outward of the foundation member.

B9. The method of paragraph B8 further comprising filling an annulus between the foundation member and the guidance sleeve with a first material.

B10. The method of paragraph B9, wherein the first material is sand.

B11. The method of paragraph B9 or B10 further comprising removing the first material from the annulus and raising the foundation member out of the seabed.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles “the”, “a” and “an” are not necessarily limited to mean only one, but rather are inclusive and open ended so as to include, optionally, multiple such elements.

What is claimed is:

1. A marine hydrocarbon operations structure comprising:

a caisson body having a top surface which defines an opening, the caisson body is constructed and arranged to be positioned proximate a seabed;

a shaft positioned within the opening, the shaft has an external surface and an interior, the shaft having an engagement member positioned on the external surface of the shaft;

a lower jack house system constructed and arranged to change the vertical position of the shaft through interaction with the engagement member; and an operations platform supported by the shaft.

2. The structure of claim 1 further comprising:

a jack-up leg positioned within the interior of the shaft; and an upper jack house system mechanically coupled to the jack-up leg and constructed and arranged to change the vertical position of the jack-up leg, wherein the platform is supported by the jack-up leg.

3. The structure of claim 2, wherein the upper jack house system is affixed to the external surface of the shaft.

4. The structure of claim 1 further comprising a base structure having a lower surface and a support surface, the lower surface is constructed and arranged to engage the seabed, the support surface is constructed and arranged to engage a bottom portion of the caisson body.

5. The structure of claim 4, wherein the support surface is recessed from an upper surface of the base structure.

6. The structure of claim 2, wherein the engagement member is a rack member having a plurality of rack teeth.

7. The structure of claim 6, wherein the upper jack house system comprises at least one pinion gear having a plurality of pinion teeth constructed and arranged to matingly engage the rack teeth.

8. The structure of claim 7, wherein the upper jack house system comprises a chock member having a plurality of chock teeth constructed and arranged to conform to the rack teeth.

9. The structure of claim 8, wherein the upper jack house system comprises an actuator mechanically coupled to the chock member, the actuator is constructed and arranged to move the chock member between a first position and a second position.

10. The structure of claim 7, wherein the at least one pinion gear is constructed and arranged to be driven by an electric drive mechanism.

11. The structure of claim 1, wherein the caisson body is a gravity based structure.

12. The structure of claim 1, wherein the lower jack house system is attached to the top surface of the caisson body.

13. The structure of claim 1, wherein the caisson body and shaft are constructed and arranged to resist ice loads.

14. The structure of claim 1, wherein the hydrocarbon operations comprises drilling, the platform supports a drilling derrick which is operatively connected to a drilling riser, a first portion of the drilling riser is positioned within the interior of the shaft.

15. The structure of claim 1 further comprising:

at least one foundation member positioned within the caisson; and means associated with each foundation member for vertically moving the associated foundation member into the seabed.

16. The structure of claim 15, wherein the means for vertically moving the associated foundation member into the seabed is at least one jack house system.

17. The structure of claim 15, wherein the means for vertically moving the associated foundation member into the seabed is a suction caisson system comprising a pump and control umbilical.

18. The structure of claim 17, wherein a portion of the control umbilical is located within the shaft.

19. The structure of claim 15 further comprising a guiding sleeve positioned radially outward from foundation member.

20. A method for installing a mobile drilling structure comprising:

providing the mobile drilling structure which comprises a caisson body having a top surface which defines an opening, the caisson body houses a plurality of ballast tanks, a shaft positioned within the opening, the shaft having an engagement member positioned on the external surface of the shaft, a lower jack house system constructed and arranged to change the vertical position of the shaft through interaction with the engagement member, and a drilling platform supported by the shaft;

delivering the mobile drilling structure to a drill site;

adding water to at least one of the plurality of ballast tanks;

operating the lower jack house system to raise the shaft;

engaging a bottom of the caisson body to a seabed.

21. The method of claim 20, wherein the mobile drilling structure further comprises a jack-up leg positioned within the interior of the shaft and an upper jack house system mechanically coupled to the jack-up leg and constructed and arranged to change the vertical position of the jack-up leg, wherein the platform is supported by the jack-up leg.

22. The method of claim 21 further comprising operating the upper jack house to raise platform to a clearance height.

23. The method of claim 20 further comprising installing a drilling riser that is operatively connected to a drilling derrick on the platform, wherein a portion of the drilling riser is positioned within the shaft.

24. The method of claim 20, wherein the mobile drilling structure further comprises at least one foundation member positioned within the caisson.

25. The method of claim 24 further comprising lowering the at least one foundation member into the seabed.

26. The method of claim 25, wherein the at least one foundation member is lowered into the seabed through operation of a jack house system mechanically coupled to the foundation member.

27. The method of claim 24, wherein the at least one foundation member is lowered into the seabed through operation of a suction caisson system comprising a pump and a control umbilical.

28. The method of claim 27, wherein the suction caisson system further comprises a guidance sleeve positioned radially outward of the foundation member.

29. The method of claim 28 further comprising filling an annulus between the foundation member and the guidance sleeve with a first material.

30. The method of claim 29, wherein the first material is sand.

31. The method of claim 29 further comprising removing the first material from the annulus and raising the foundation member out of the seabed.

32. A marine hydrocarbon operations structure comprising:

an operations platform;

a caisson body having a top surface which defines an opening and a bottom constructed and arranged to engage a seabed;

a shaft positioned within the opening extending between the caisson body and the operations platform, the shaft has an external surface and an interior, the shaft having an engagement member positioned on the external surface of the shaft; and a lower jack house system constructed and arranged to change the vertical position of the shaft through interaction with the engagement member.

33. A marine hydrocarbon operations structure comprising:

an operations platform;

a caisson body having a top surface which defines an opening;

a base structure having a lower surface and a support surface, the lower surface is constructed and arranged to engage a seabed, the support surface is constructed and arranged to engage a bottom portion of the caisson body;

a shaft positioned within the opening extending between the caisson body and the operations platform, the shaft has an external surface and an interior, the shaft having an engagement member positioned on the external surface of the shaft; and a lower jack house system constructed and arranged to change the vertical position of the shaft through interaction with the engagement member.

* * * * *